United States Patent [19]

Narasimhan

[11] 4,221,257

[45] Sep. 9, 1980

[54] CONTINUOUS CASTING METHOD FOR METALLIC AMORPHOUS STRIPS

[75] Inventor: Mandayam C. Narasimhan, Flanders, N.J.

[73] Assignee: Allied Chemical Corporation, Morris Township, Morris County, N.J.

[21] Appl. No.: 949,839

[22] Filed: Oct. 10, 1978

Related U.S. Application Data

[60] Division of Ser. No. 821,110, Aug. 2, 1977, Pat. No. 4,142,571, which is a continuation-in-part of Ser. No. 734,776, Oct. 22, 1976, abandoned.

[51] Int. Cl.[2] ..... B22D 11/06; B22D 11/10

[52] U.S. Cl. ..... 164/87; 164/429; 164/437

[58] Field of Search ..... 164/87, 427, 429, 437, 164/88, 439, 256, 423

[56] References Cited

U.S. PATENT DOCUMENTS

| | | | |
|---|---|---|---|
| 905,758 | 12/1908 | Strange et al. | 164/87 |
| 2,864,137 | 12/1958 | Brennan | 164/87 X |
| 3,427,154 | 2/1969 | Mader | 75/135 X |
| 3,522,836 | 8/1970 | King | 164/87 |
| 3,605,863 | 9/1971 | King | 164/4 X |
| 3,862,658 | 1/1975 | Bedell | 164/423 X |
| 3,938,583 | 2/1976 | Kavesh | 164/429 X |
| 3,976,117 | 8/1976 | Olsson | 164/429 X |
| 4,077,462 | 3/1978 | Bedell et al. | 164/429 |

FOREIGN PATENT DOCUMENTS

| | | | |
|---|---|---|---|
| 20518 | 10/1909 | United Kingdom | 164/429 |

OTHER PUBLICATIONS

Chen, H. S., et al. "A Rapid Quenching Technique for the Preparation of Thin Uniform Films of Amorphous Solids," *Rev. Sci. Inst.*, vol. 41, pp. 1237–1238, 1970.

Chen, H. S. et al., "Centrifugal Spinning of Metallic Glass Filaments," *Mat. Res. Bull.*, vol. 11, pp. 49–54, 1976.

*Primary Examiner*—Robert D. Baldwin
*Assistant Examiner*—Gus T. Hampilos
*Attorney, Agent, or Firm*—Gerhard H. Fuchs

[57] ABSTRACT

Continuous metal strips are formed by forcing molten metal onto the surface of a moving chill body under pressure through a slotted nozzle located in close proximity to the surface of the chill body. Critical selection of nozzle dimensions, velocity of movement of the chill body surface, and gap between nozzle and chill body surface permits production of continuous polycrystalline metal strip at high speeds, and of amorphous metal strips having high isotropic strengths, heretofore unobtainable dimensions, and other isotropic physical properties such as magnetizability.

13 Claims, 7 Drawing Figures

CONTINUOUS CASTING METHOD FOR METALLIC AMORPHOUS STRIPS

This application is a division of application Ser. No. 821,110, filed Aug. 2, 1977, now U.S. Pat. No. 4,142,571, which in turn is a continuation-in-part of Ser. No. 734,776, filed Oct. 22, 1976, now abandoned.

BACKGROUND OF THE INVENTION

This invention relates to a method and apparatus for making continuous metal strips, particularly metal strips with an amorphous molecular structure, by depositing molten metal onto the moving surface of a chill body by forcing the metal through a slotted nozzle located in close proximity to the surface of the chill body.

For purposes of the present invention, a strip is a slender body whose transverse dimensions are much less than its length, including wire, ribbons and sheets, of regular or irregular cross section.

There has long been recognized the need for processes which would permit manufacture of finished or semifinished products such as wire, ribbon or sheet directly from the molten metal. Hubert et al. provided a review of such processes and classified then available technology into the "melt spin process" and the "melt drag process", [Zeitschrift fuer Metallkunde 64, 835-843 (1973)].

In the melt spin process, a jet of molten metal is cooled, either in free flight or by jetting it against a chill block, to obtain continuous filament. Both of these embodiments employ a pressurized orifice. There is also a melt spin process operating without an orifice, wherein molten metal is supplied to a jet-forming device, such as a grooved spinning disc, to be expelled therefrom. Hubert et al. stated that the key to success in the melt spin process is to stabilize the liquid jet until it solidifies. Jets of molten metal are inherently unstable since they have a strong tendency for droplet formation on account of the low viscosity and high surface tension of molten metal. Basic problems of jet stability have been discussed by Butler et al., in Fiber Science and Technology 5, 243-262 (1972).

In the melt drag process (see U.S. Pat. Nos. 3,522,836 and 3,605,863, both to King molten metal is made to form a meniscus held on by surface tension, at the outlet of a nozzle. From this meniscus molten metal is then dragged onto a rotating continuous cooled drum or belt. This method avoids the difficulties of jet instability inherent in the melt spin process. Unfortunately, however, the speed of the moving chill surface in the melt drag process is severely restricted due to restriction in melt flow at the meniscus, or else only discontinuous filament is obtained. Also, it is believed that the melt drag process is not readily adaptable to provide sufficiently high rates of cooling of the molten metal to permit production of amorphous metal strips. Such strips require rapid quenching of certain molten alloys at a cooling rate of at least $10^{4}$° C. per second, more usually $10^{6}$° C. per second.

Continuous amorphous metal strips of narrow widths and thicknesses have heretofore been made by the melt spin process involving rapid quenching of a jet of molten metal directed against a moving chill surface, such as the inside or outside of a rotating roll, or a moving belt. The molten alloy jet which is to be quenched is stable due to its high velocity for a relatively short distance, say 3 to about 6 millimeters. When it hits the rapidly moving chill substrate (velocity typically between about 1300 and about 2000 meters per minute) it wets it and forms a puddle. That puddle is essentially stationary in space as the moving substrate draws it out into a strip, which is traveling at the same speed as the substrate. In actual application, it has been found that, using a single jet, the maximum width of strip so obtained from a jet of substantially circular cross section is limited to about 5 to 6 millimeters. Attempts to provide wider strips by impinging a sheet-like jet against a moving chill surface met with little success, principally because the wide jet initially does not form a smooth line puddle as required to obtain a uniform, wide product, and consequently produces kinky, nonuniformly quenched strip.

It is also possible to impinge a plurality of parallel, uniform jets properly spaced onto a moving substrate to form a relatively wide strip. This approach, however, has inherent difficulties inasmuch as it requires a close matching of the jet velocities and spacings with the substrate speed. The principal difficulty is that either the jets do not join together to form a puddle, or the jets run together to form a ridge, so that, from a practical standpoint, it is difficult to obtain strips with uniform cross sections. Moreover, since the molten metal puddle deposited by the jets onto the chill substrate tends to assume the equilibrium shape of a droplet, thick at the center and thin at the edges, it is very difficult, if not impossible, to maintain a puddle of sufficiently uniform thickness for "drawing out" strips having even approximately uniform cross section wider than about 7.5 mm.

In any event, it has not been possible to obtain wide metal strips, say wider than about 6 millimeters, by single or multiple jet casting procedures having isotropic strengths, that is to say having identical tensile strengths and elongation measured in the transverse as well as in the longitudinal direction, or in any direction therebetween, even though metal strips with amorphous structures should be isotropic at least with respect to their tensile properties, and those with cast polycrystalline structures should be approximately isotropic. Anisotropic tensile properties of wide strips of amorphous metal obtained by multiple jet casting procedure are believed to be caused by inherent imperfections in the strips obtained by that procedure. Significantly, however, strips made by jet casting procedures, regardless of width, lack uniformity of thickness, measured transversely, and they are prone to show significant variations in width along their length. They lack such uniformity of thickness because they are drawn out from a puddle of liquid metal, which puddle has a strong tendency to assume the equilibrium shape of a droplet on account of the high surface tension of molten metal; they are prone to variations in width because even slight unavoidable variations in the flow rate of the molten metal through the orifice to form the jet will cause variations in the diameter of the puddle with resultant variations in width of the strip drawn therefrom.

U.S. Pat. No. 3,862,658 to Bedell inter alia discloses a method for making amorphous strips (filaments) by ejecting molten alloy into the nip of two closely spaced counter-rotating steel rolls. This method provides for rapid, effective cooling of the melt, but involves rolling of the solidified strip between the steel rolls, as a result of which the product has anisotropic tensile properties. By that method Bedell obtained an amorphous ribbon of 0.012 centimeters thickness and 1.27 centimeters width (Example 4 of U.S. Pat. No. 3,862,658).

British Patent No. 20,518 to Strange, and U.S. Pat. No. 905,758 to Strange and Pim further illustrate processes for making sheets, foils, strips, or ribbons of metals by depositing molten metal onto a moving chill surface.

SUMMARY OF THE INVENTION

In accordance with the present invention, it has been found that, if a thin uniform layer of molten metal is mechanically supported on a chill surface by the method and apparatus of our invention, it becomes possible to draw out thin metal strips in the form of wires, ribbons and sheets with aspect ratios (width/-thickness) ranging from unity to any desired value, as below described.

Accordingly, the present invention provides an apparatus for making continuous metal strip from the melt. It comprises a movable chill body, a slotted nozzle in communication with a reservoir for holding molten metal, and means for effecting expulsion of the molten metal from the reservoir through the nozzle onto the moving chill surface.

The movable chill body provides a chill surface for deposition thereon of molten metal for solidification. The chill body is adapted to provide longitudinal movement of the chill surface at velocities in the range of from about 100 to about 2000 meters per minute.

The reservoir for holding molten metal includes heating means for maintaining the temperature of the metal above its melting point. The reservoir is in communication with the slotted nozzle for depositing molten metal onto the chill surface.

The slotted nozzle is located in close proximity to the chill surface. Its slot is arranged perpendicular to the direction of movement of the chill surface. The slot is defined by a pair of generally parallel lips, a first lip and a second lip, numbered in direction of movement of the chill surface. The slot must have a width, measured in direction of movement of the chill surface, of from about 0.3 to about 1 millimeter. There is no limitation on the length of the slot (measured perpendicular to the direction of movement of the chill surface) other than the practical consideration that the slot should not be longer than the width of the chill surface. The length of the slot determines the width of the strip or sheet being cast.

The width of the lips, measured in direction of movement of the chill surface, is a critical parameter. The first lip has a width at least equal to the width of the slot. The second lip has a width of from about 1.5 to about 3 times the width of the slot. The gap between the lips and the chill surface is at least about 0.1 times the width of the slot, but may be large enough to equal the width of the slot.

Means for effecting expulsion of the molten metal contained in the reservoir through the nozzle for deposition onto the moving chill surface include pressurization of the reservoir, such as by an inert gas, or utilization of the hydrostatic head of molten metal if the level of metal in the reservoir is located in sufficiently elevated position.

The invention further provides a method for forming a continuous metal strip by depositing molten metal onto the surface of a moving chill body, which involves moving the surface of a chill body in a longitudinal direction at a constant, predetermined velocity within the range of from about 100 to about 2000 meters per minute past the orifice of a slotted nozzle defined by a pair of generally parallel lips located proximate to said surface such that the gap between the lips and the surface is from between about 0.03 to about 1 millimeter, and forcing a stream of molten metal through the orifice of the nozzle into contact with the surface of the moving chill body to permit the metal to solidify thereon to form a continuous metal strip. The orifice of the slotted nozzle is being arranged generally perpendicular to the direction of movement of the surface of the chill body. Desirably, the molten metal is an alloy which, upon cooling from the melt and quenching at a rate of at least about $10^{4°}$ C./sec. forms an amorphous solid; it may also form a polycrystalline metal.

The present invention further provides a novel strip product comprised of a metal having an amorphous structure which conveys exceptional properties to it. Such amorphous strip product, as ribbons or sheets, having width of at least about 7 millimeters, preferably at least about 1 centimeter, have isotropic strengths and other isotropic physical properties, such as magnetizability.

BRIEF DESCRIPTION OF THE DRAWINGS

In FIG. 2, formation of strip takes place on the surface of a chill roll mounted to rotate around its longitudinal axis. In FIG. 3, formation of strip takes place on the surface of an endless moving belt.

FIG. 6 illustrates a generally rectangular slot; FIG. 7 illustrates a slot having enlarged (lobed) end sections.

DETAILED DESCRIPTION OF THE INVENTION AND THE PREFERRED EMBODIMENTS

The method of casting a continuous strip of the present invention may be termed "planar flow casting." Its principle of operation is explained in the following with reference to FIG. 1.

Figure 1:
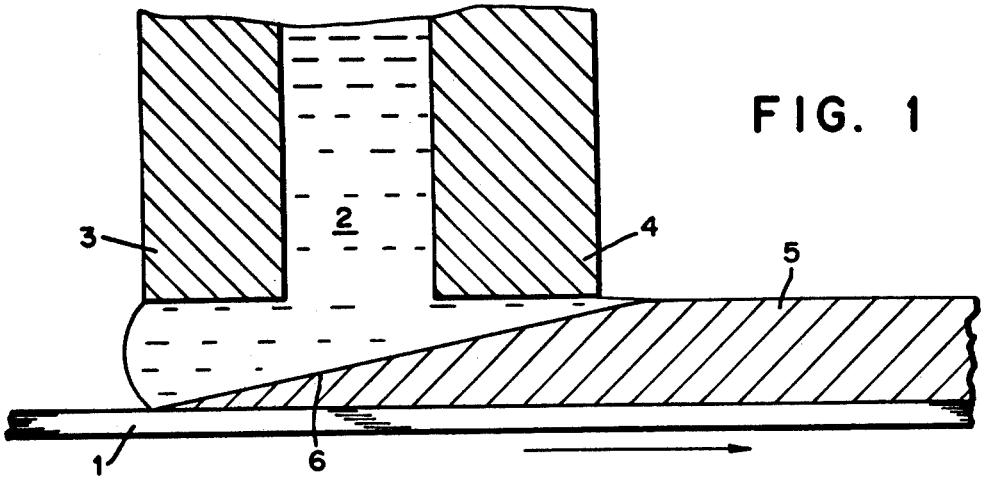
FIG. 1 of the drawings provides a side view in partial cross section illustrating formation of strip from molten metal deposited onto a moving chill surface from a nozzle having specific configuration and placement with relation to the chill surface, in accordance with the present invention.

FIG. 1 shows in partial cross section a side view illustrating the method of the present invention. As shown in FIG. 1, a chill body 1, here illustrated as a belt, travels in the direction of the arrow in close proximity to a slotted nozzle defined by a first lip 3 and a second lip 4. Molten metal 2 is forced under pressure through the nozzle to be brought into contact with the moving surface of the chill body. As the metal is solidified in contact with the surface of the moving chill body, a solidification front, indicated by line 6, is formed. Above the solidification front a body of molten metal is maintained. The solidification front barely misses the end of second lip 4. First lip 3 supports the molten metal essentially by the pumping action of the melt which results from constant removal of solidified strip 5. The surface of the moving chill body 1 travels at a velocity within the range of from about 100 to about 2000 meters per minute. The rate of flow of molten metal equals the rate of removal of metal in the form of solid strip and is self-controlled. The rate of flow is pressure assisted, but controlled by the forming solidification front and the second lip 4 which mechanically supports the molten metal below it. Thus, the rate of flow of the molten metal is primarily controlled by the viscous flow between the second lip and the solid strip being formed, and is not primarily controlled by the slot width. In order to obtain a sufficiently high quench-rate to make an amorphous ribbon, the surface of the chill body must ordinarily move at a velocity of at least about 200 meters per minute. At lower velocities it is generally not possible to obtain quench rates, that is to say cooling rates at the solidification temperature, of at least $10^4$° C. per second, as is required in order to obtain amorphous metal strips. Of course, lower velocities, as low as about 100 meters per minute, are usually operable, but result in polycrystalline strips. And, in any event, casting by my process of metal alloys which do not form amorphous solids will result in polycrystalline strips, regardless of the velocity of travel of the chill surface. The velocity of movement of the chill surface should not be in excess of about 2000 meters per minute because as the speed of the substrate increases, the height of the solidification front is depressed due to decreased time available for solidification. This leads to formation of thin strip (thickness less than about 0.02 millimeter). Since the success of my process hinges on thorough wetting of the chill substrate by the molten metal, and since very thin layers of molten metal (e.g. thinner than about 0.02 millimeter) do not adequately wet the chill substrate, thin, porous strip is obtained which is not commercially acceptable. This is particularly pronounced if the casting operation is carried out other than in vacuum, since currents of the ambient gas, such as air, have substantial adverse influence on strip formation at higher substrate speeds. As a general proposition, it can be stated that an increase in chill surface velocity results in production of thinner strip and, conversely, that a reduction of that velocity results in thicker strip. Preferably, velocities range from about 300 to about 1500, more preferably from about 600 to about 1000 meters per minute.

Figure 4:
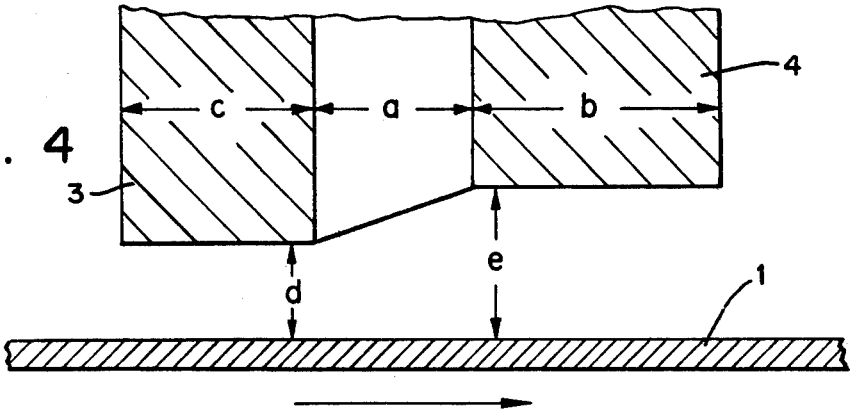
FIG. 4 provides a side view in cross section of a nozzle in its relation to the surface of the chill substrate for discussion of relative dimensions of slot width, lip dimensions, and gap between lip and chill surface.

In order to obtain solid continuous strip of uniform cross section, certain dimensions concerning the nozzle and its interrelationship with the chill surface are critical. They are explained with reference to FIG. 4 of the drawings. With reference to FIG. 4, width a of the slot of the slotted nozzle, which slot is arranged perpendicular to the direction of movement of the chill surface, should be from about 0.3 to about 1 millimeter, preferably from about 0.6 to about 0.9 millimeter. As previously stated, the width of the slot does not control the rate of flow of molten metal therethrough, but it might become a limiting factor if it is too narrow. While, to some extent that may be compensated for by employing higher pressures to force the molten metal at the required rate through the narrower slot, it is more convenient to provide a slot of sufficient width. If, on the other hand, the slot is too wide, say wider than about 1 millimeter, then at any given velocity of movement of the chill surface, the solidification front formed by the metal as it solidifies on the chill surface will be correspondingly thicker, resulting in a thicker strip which could not be cooled at a rate sufficient to obtain amorphous strip, if this were desired.

With further reference to FIG. 4, width b of second lip 4 is about 1.5 to about 3 times the width of the slot, preferably from about 2 to about 2.5 times the width of the slot. Optimum width can be determined by simple routine experimentation. If the second lip is too narrow, then it will fail to provide adequate support to the molten metal and only discontinuous strip is produced. If, on the other hand, the second lip is too wide, solid-to-solid rubbing between the lip and the strip will result, leading to rapid failure of the nozzle. With further reference to FIG. 4, width c of first lip 3 must be at least about equal to the width of the slot, preferably at least about 1.5 times the width of the slot. If the first lip is too narrow, then the molten metal will tend to ooze out, the molten metal will not uniformly wet the chill surface, and no strip, or only irregular strip will be formed. Preferred dimensions of the first lip are from about 1.5 to about 3, more preferably from about 2 to about 2.5 times the width of the slot.

Still with reference to FIG. 4, the gap between the surface of the chill body 1 and first and second lips 3 and 4, respectively represented by d and e, may be from about 0.03 to about 1 millimeter, preferably from about 0.03 to about 0.25 millimeter, more preferably yet from about 0.08 to about 0.15 millimeter. A gap in excess of about 1 millimeter would cause flow of the molten metal to be limited by slot width rather than by the lips. Strips produced under this condition are thicker, but are of non-uniform thickness. Moreover, they usually are insufficiently quenched and consequently have non-uniform properties. Such product lacks commercial acceptability. On the other hand, a gap of less than about 0.03 millimeter would lead to solid-to-solid contact between the solidification front and the nozzle when the slot width is in excess of about 0.3 millimeter, leading to rapid failure of the nozzle. Within the above parameters, the gap between the surface of the chill body and the lips may vary. It may for example, be larger on one side than the other, so that a strip of varying thickness across its width is obtained.

When the chill surface is a flat surface, such as a belt, the gaps between the surface of the chill surface and the first and second lips represented by dimensions d and e in FIG. 4 may be equal. If however, the movable chill body furnishing the chill surface is an annular chill roll then these gaps may not be equal, or else the strip formed will not separate from the chill roll, but it will be carried around the perimeter of of the roll and will hit and destroy the nozzle. I have surprisingly found that this can be avoided by making gap d smaller than gap e, that is to say, by providing a smaller gap between the first lip and the chill surface than between the second lip and the chill surface. I have further surprisingly found that the larger the difference in the size of the gap between the first and the second lip and the chill surface, the closer to the nozzle the strip will separate from the chill surface so that, by controlling the difference between these gaps, the point of separation of the strip from the annular chill roll can be controlled. Such difference in gaps can be established by slightly tilting the nozzle so that its exit points in direction of rotation of the chill roll, or by off-center mounting of the nozzle. I have further noted that residence time of the strip on an annular chill roll tends to increase with increasing gap between the nozzle and the chill surface.

Within the above parameters, when, for example, the chill surface may be moved at a velocity of about 700 meters per minute, the width of the slot may be between about 0.5 to 0.8 millimeter. The second lip should be between about 1.5 to 2 times the width of the slot, and the first lip should be about 1 to 1.5 times the width of the slot. The metal in the reservoir should be pressurized to between about 0.5 to 2 psig. The gap between the second lip and the substrate may be between about 0.05 to 0.2 millimeter. If an annular chill roll is employed, the gap between the first lip and the surface of the chill body must be less than the gap between the second lip and the surface of the chill body, as above discussed. This can, for example, be accomplished by off-center mounting of the nozzle. Increasing the gap and/or the gas pressure increases the strip thickness when the velocity of movement chill surface remains unchanged.

Figure 2:
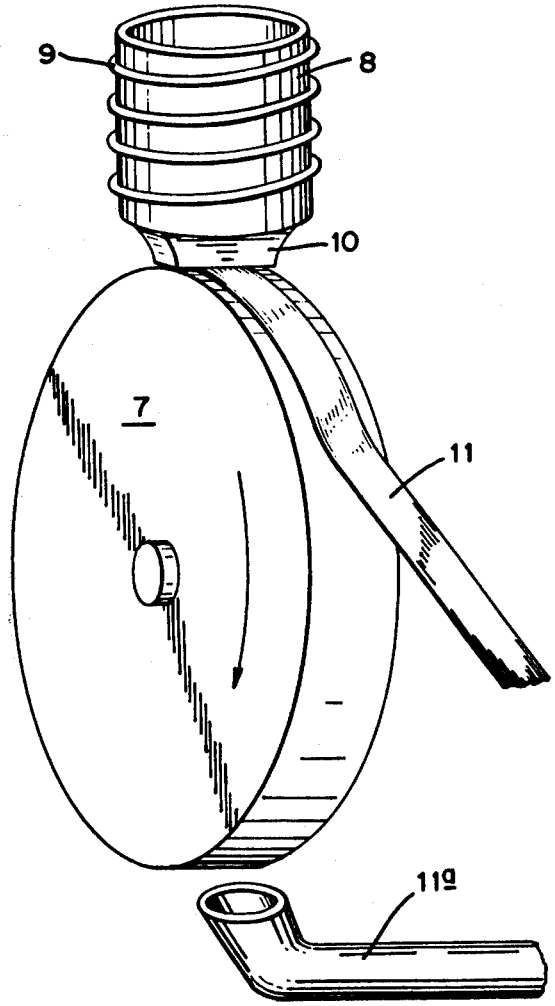
FIGS. 2 and 3 of the drawings each provide a somewhat simplified perspective view of two embodiments of apparatus of the present invention in operation.

With reference to FIG. 2 of the drawings, which provides a perspective view of apparatus for carrying out the method of the present invention, there is shown an annular chill roll 7 rotably mounted around its longitudinal axis, reservoir 8 for holding molten metal equipped with induction heating coils 9. Reservoir 8 is in communication with slotted nozzle 10, which, as above described, is mounted in close proximity to the surface of annular chill roll 7. Annular chill roll 7 may optionally be provided with cooling means (not shown), as means for circulating a cooling liquid, such as water, through its interior. Reservoir 8 is further equipped with means (not shown) for pressurizing the molten metal contained therein to effect expulsion thereof through nozzle 10. In operation, molten metal maintained under pressure in reservoir 8 is ejected through nozzle 10 onto the surface of the rotating chill roll 1, whereon it immediately solidifies to form strip 11. Due to unequal gaps between the first and second lips of the nozzle and the chill roll surface, as above discussed, strip 11 separates from the chill roll and is flung away therefrom to be collected by a suitable collection device (not shown). In FIG. 2 there is further shown nozzle 11*a* adapted to direct a stream of inert gas, such as helium, argon or nitrogen, against the surface of the chill roll ahead of slotted nozzle 10, for purposes described further below.

Figure 3:
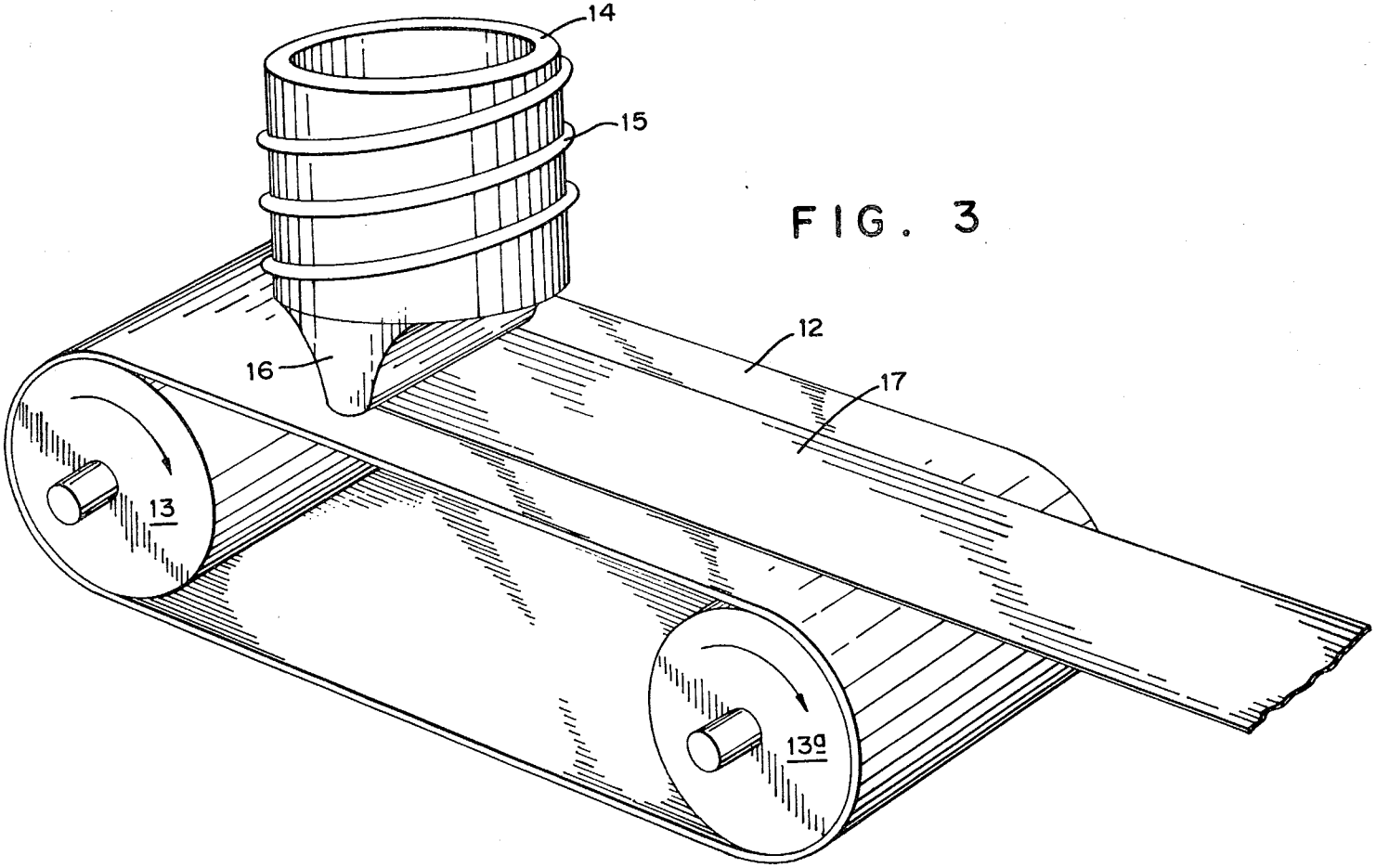

The embodiment illustrated by FIG. 3 of the drawings employs as chill body an endless belt 12 which is placed over rolls 13 and 13*a* which are caused to rotate by external means (not shown). Molten metal is provided from reservoir 14, equipped with means for pressurizing the molten metal therein (not shown). Molten metal in reservoir 14 is heated by electrical induction heating coil 15. Reservoir 14 is in communication with nozzle 16 equipped with a slotted orifice. In operation, belt 10 is moved at a longitudinal velocity of at least about 600 meters per minute. Molten metal from reservoir 14 is pressurized to force it through nozzle 16 into contact with belt 12, whereon it is solidified into a solid strip 17 which is separated from belt 12 by means not shown.

The surface of the chill body which provides the actual chill surface can be any metal having relatively high thermal conductivity, such as copper. This requirement is particularly applicable if it is desired to make amorphous or metastable strips. Preferred materials of construction include beryllium copper and oxygen free copper. If desired, the chill surface may be highly polished or may be provided with a highly uniform surface, such as chrome plate, to obtain filament having smooth surface characteristics. To provide protection against erosion, corrosion, or thermal fatigue, the surface of the chill body may be coated with a suitable resistant or high melting coating, for example, a ceramic coating, or with a coating of corrosion resistant high melting metal, which may be applied by known procedures provided that in each case the wettability of the molten metal on the chill substrate is adequate.

In short run operation it will not ordinarily be necessary to provide cooling for the chill body provided it has relatively large mass so that it can act as a heat sink and absorb considerable amount of heat. However, for longer runs, and especially if the chill body is a belt which has relatively little mass, cooling of the chill body is desirably provided. This may be conveniently accomplished by contacting it with cooling media which may be liquids or gases. If the chill body is a chill roll, water or other liquid cooling media may be circulated through it, or air or other gases may be blown over it. Alternatively, evaporative cooling may be employed, as by externally contacting the chill body with water or any other liquid medium which through evaporation provides cooling. Even though one might expect considerable variations in thickness along the length of the strip due to thermal expansion of the chill surface as the casting process progresses, I have in my experiments surprisingly found that equilibrium conditions apparently are established very rapidly, within production of a few meters of strip, and that thereafter the strip is of remarkably uniform thickness from end to end. For example, thickness along the length of the strip has been found to vary as little as about $\pm 5$ percent. This is particularly remarkable since ordinarily unavoidable runout of the chill roll will be of larger magnitude than the variation in thickness. In a way, my process is self-compensating for wear-generated variations in gap between lips and chill surface. Furthermore, strip made by my process is of remarkably uniform width, with variations in width along the length having been measured as small as about $\pm 0.0004$ centimeter. Such uniformity of width is believed to be unobtainable employing conventional melt spin procedures; strip of such uniform width would ordinarily only be obtained employing cutting procedures.

Figure 5:
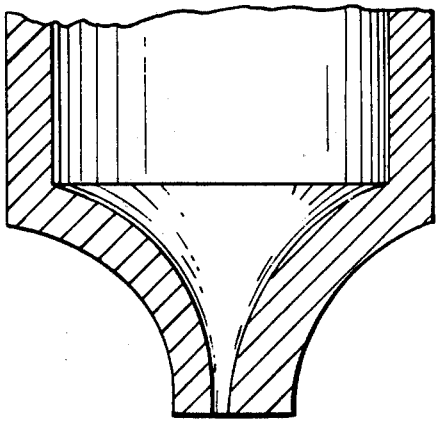
FIG. 5 provides a cross sectional view taken in a plane perpendicular to direction of movement of the chill surface illustrating a preferred embodiment of a nozzle employed in the practice of the present invention providing concave-shaped internal side walls.
Figure 6:
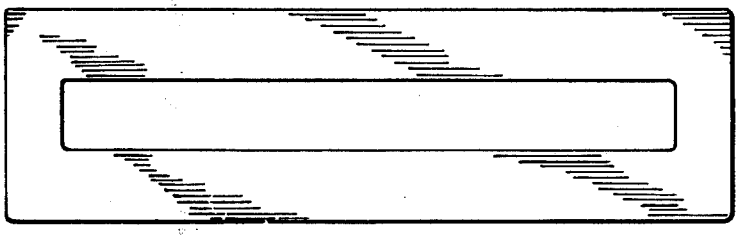
FIGS. 6 and 7 each provide a schematic view of the shape of the slot of a slotted nozzle in accordance with the present invention, seen from the surface of the chill substrate.
Figure 7:
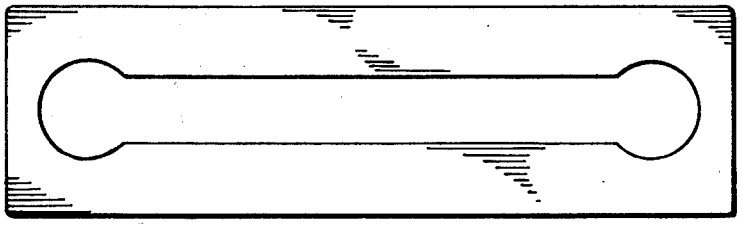

The slotted nozzle employed for depositing molten metal onto the chill surface may be constructed of any suitable material. Desirably, a material is chosen which is not wetted by the molten metal. A convenient material of construction is fused silica, which may be blown into desired shape and then be provided with a slotted orifice by machining. For the sake of convenience, the reservoir and the nozzle may be shaped from a single piece of material. A suitable form of nozzle employing concave lower walls terminating in a slot is illustrated by FIG. 5. Nozzles of that configuration have been found very effective. The shape of the slot may be substantially rectangular as illustrated by FIG. 6. Preferably, the ends of the slot are lobed, as in generally rounded form as illustrated by FIG. 7 to provide adequate flow of molten metal at the marginal portions. The velocity of flow of metal near the nozzle walls is always lower than the velocity near the center. Therefore, when a rectangular slot such as illustrated by FIG. 6 is employed, the amount of molten metal available at the marginal portions is less than at the center, resulting in a filament having tapered or serrated edges. If, on the other hand, the slot is formed with lobed ends, as shown in FIG. 7, adequate flow of molten metal at the ends of the slot is provided and a smooth-edged filament is obtained.

The molten metal which is to be formed into a strip by means of the method of the present invention is heated, preferably in an inert atmosphere, to temperature approximately 50° to 100° C. above its melting point or higher. A slight vacuum may be applied to the vessel holding the molten metal to prevent premature flow of the molten metal through the nozzle. Ejection of the molten metal through the nozzle is required and may be effected by the pressure of the static head of the molten metal in the reservoir, or preferably by pressurizing the reservoir to pressure in the order of, say, 0.5 to 1 psig, or until the molten metal is ejected. If pressures are excessive, more molten metal may be forced through the slot than can be carried away by the chill surface resulting in uncontrolled pressure flow. In a severe case, splattering of the molten metal may result. In a less severe case, strip having a ragged, irregular edge and of irregular thickness will be formed. Correctness of pressure can be judged by the appearance of the strip; if it is uniformly dimensioned, correct pressure is applied. Correctness of pressure can be judged during the casting operation by the appearance of the strip in the vicinity of the second lip. Under conditions of uncontrolled pressure flow, the molten metal, as indicated by its red glowing appearance, extends well pass the second lip. Under controlled conditions, the melt does not flow past the second lip to any significant extent, and no redness is observed. Correct pressure can thus be readily determined by simple, routine experimentation for each particular set of circumstances.

Metals which can be formed into polycrystalline strip directly from the melt by my process include aluminum, tin, copper, iron, steel, stainless steel and the like.

Metal alloys which, upon rapid cooling from the melt, form solid amorphous structures are preferred. These are well known to those skilled in the art. Exemplary such alloys are disclosed in U.S. Pat. Nos. 3,427,154 and 3,981,722, as well as others.

The method and apparatus of the present invention have several distinct advantages. They make possible casting of wide strips of amorphous metal alloys, avoiding the disadvantages of free jet casting, as above discussed. They provide more uniformly dimensioned strips, with respect to width as well as thickness, with fewer imperfections, having isotropic tensile properties. Amorphous strip of greater thickness can be cast, because my method provides a quench rate which is by about a factor of 10 higher than that obtainable by known jet impingement techniques. This is demonstrated by the fact that my method is capable of casting amorphous strips from alloys, such as $Pd_{75}Si_{25}$ which cannot be obtained in amorphous form by jet impingement methods of the prior art. Furthermore, jet impingement methods of the prior art are not capable of making strips having width in excess of about 6 millimeters and having isotropic tensile properties. My method provides for uniformity of quench due to reduced momentum transfer, inter alia, which appears to be an important factor for obtainment of high quality product strip.

Furthermore, the method of the present invention provides ready means for casting of metal in an inert atmosphere. Such inert atmosphere may be readily provided by the simple expedient of directing a stream of inert gas such as nitrogen, argon or helium against the moving chill surface ahead of the nozzle, as illustrated in FIG. 2. By this simple expedient, it is possible to cast reactive alloys such as $Fe_{70}Mo_{10}C_{18}B_2$ which burn readily when exposed to air in molten form and which cannot be cast in air by conventional jet impingement methods.

The process of the present invention may be carried out in air, in a partial or high vacuum, or in any desired atmosphere which may be provided by an inert gas such as nitrogen, argon, helium, and the like. When it is conducted in vacuum, it is desirably conducted under vacuum within the range of from about 100 up to about 3000 microns. I have made the surprising discovery that in my process use of vacuum below about 100 or 50 microns has unexpectedly adverse influence on adhesion of the metal strip to the chill surface, with resultant tendency to form imperfect, insufficiently quenched strip. An amorphous quenching alloy may lack ductility and be brittle instead. I have no explanation for this phenomenon at present. In my process the benefits of operation under vacuum, viz. improved uniformity of the strip product and elimination of oxidative attack, are obtained by operation under vacuum within the above stated range, preferably by operation under vacuum within the range of from about 200 micron to about 2000 micron. The benefit of operation in an inert atmosphere is obtained by merely directing a stream of the inert gas against the surface of the moving chill body ahead of the nozzle as above described. Alternatively, the apparatus can be enclosed in a suitable housing which is then evacuated, or the air in the housing may be replaced with the desired inert gas. While the method of the present invention is particularly suited for making amorphous metal strips because of the improved quench rate which it provides, as above discussed, it is also eminently suited for making strips of polycrystalline metals and of nonductile or brittle alloys which are not readily formable into strip using conventional procedures.

The product of the present invention is a strip of metal with an amorphous molecular structure having width of at least about 7 millimeters, preferably at least about 1 centimeter, and, more preferably yet, having width of at least about 3 centimeters. The strip of the present invention is at least about 0.02 millimeter thick, but may be as thick as about 0.14 millimeter, or thicker, depending on the melting point, solidification and crystallization characteristics of the alloy employed. The product has isotropic tensile properties, as above described. These tensile properties are conveniently determined on tensile specimens cut from the strip in various directions, viz. longitudinal, transverse, and at angles therebetween, employing standard tensile testing methods and apparatus. The product is further characterized by smooth, even surfaces, and uniformity of cross section as well as of thickness and width along its length. It has all of the advantageous properties of known amorphous metal strips, so that it is suitable for use in applications in which such strips have been previously employed, e.g. in cutting implements and magnetic shielding devices. In these applications its greater width is a decided advantage. Additionally, because of its greater width coupled with its isotropic tensile properties, it is eminently suited for use as reinforcement material, particularly in composite structures.

The following examples illustrates the present invention and set forth the best mode presently contemplated for its practice.

EXAMPLE 1

Apparatus employed is similar to that depicted in FIG. 2. The chill roll employed has a diameter of 16 inches and it is 5 inches wide. It is rotated at a speed of about 700 rpm, corresponding to a linear velocity of the peripheral surface of the chill roll of about 895 meters per minute. A nozzle having a slotted orifice of 0.9 millimeter width and 51 millimeter length defined by a first lip of 1.8 millimeters width and a second lip of 2.4 millimeters width (lips numbered in direction of rotation of the chill roll) is mounted perpendicular to the direction of movement of the peripheral surface of the chill roll, such that the gap between the second lip and the surface of the chill roll is 0.05 millimeter, and the gap between the first lip and the surface of the chill roll is 0.06 millimeter. Metal having composition $Fe_{40}Ni_{40}P_{14}B_6$ with a melting point of about 950° C. is employed. It is supplied to the nozzle from a pressurized crucible wherein it is maintained under pressure of about 0.7 psig at temperature of 1000° C. Pressure is supplied by means of an argon blanket. The molten metal is expelled through the slotted orifice at the rate of 14 kilograms per minute. It solidifies on the surface of the chill roll into a strip of 0.05 millimeter thickness having width of 5 centimeters. Upon examination using X-ray diffractometry, the strip is found to be amorphous in structure. Tensile specimens cut from the strip in longitudinal and transverse direction exhibit equal tensile strength and elongation. The strip has isotropic tensile properties.

EXAMPLES 2 THROUGH 6

The procedure of Example 1 was repeated, employing the equipment, process conditions, metal and alloys summarized in the Table, below, to obtain the products described in the Table.

TABLE

| Example | 2 | 3 | 4 | 5 | 6 |
|---|---|---|---|---|---|
| Metal (alloy) | Cu | Cu + 1 wt % Zn | Cu + 8 wt % Al | Al + 3 wt % Cu | $Pd_{80}Si_{20}$ (atomic %) |
| Chill Roll diameter (inch) | 16 | 16 | 16 | 16 | 7½ |
| Chill Roll width (inch) | 4 | 5 | 4 | 4 | 1½ |
| Chill Roll rpm | 714 | 714 | 714 | 600 | 1600 |
| Nozzle orifice width (mm) | 0.635 | 0.635 | 0.635 | 0.762 | 1.01 |
| Nozzle orifice length (mm) | 3 | 6 | 10 | 12 | 12 |
| Width first lip (mm) | 1.15 | 1.15 | 1.15 | 1.6 | 1.6 |
| Width second lip (mm) | 2 | 2 | 2 | 2 | 1.8 |
| Gap-second lip to chill roll (mm) | 0.12 | 0.12 | 0.12 | 0.12 | 0.25 |
| Gap-first lip to chill roll (mm) | 0.15 | 0.15 | 0.15 | 0.15 | 0.28 |
| Melting point of metal (°C.) | 1083 | ~1075 | ~1060 | ~655 | ~950 |
| Pressure applied to crucible (psig) | 0.7 | 0.7 | 0.7 | 0.5 | 0.5 |
| Temp. of metal in crucible approx. (°C.) | 1150 | 1150 | 1150 | 680 | 1000 |
| Thickness of strip (0.001 in.) | 2 | 2 | 2 | 2 | 8 |
| Width of strip (mm) | 3 | 6 | 10 | 12 | 12 |
| Structure of strip | | ←polycrystalline→ | | | amorphous |

Since various changes and modifications may be made in the invention without departing from the spirit and essential characteristics thereof, it is intended that all matter contained in the above description be interpreted as illustrative only, the invention being limited by only the scope of the appended claims.

I claim:

1. A method of forming continuous strip of amorphous metal from a molten alloy capable of forming an amorphous structure comprising:

a. forcing the molten alloy under pressure through a slotted nozzle positioned generally perpendicular to the direction of movement of a chill surface and located in close proximity to the chill surface to provide a gap of from about 0.03 to about 1 millimeter between said nozzle and the chill surface;

b. advancing the chill surface, at a predetermined speed; and c. quenching the molten metal in contact with the chill surface at a rapid rate to effect solidification into a continuous amorphous metal strip.

2. The method of claim 1 wherein the chill surface is advanced relative to said nozzle at a velocity of from about 200 to about 2000 meters per minute.

3. The method of claim 1 wherein the molten alloy is quenched at a rate of at least $10^4$° C. per second.

4. The method of claim 1 wherein the slotted nozzle is located in close proximity to the chill surface to provide a gap of from about 0.03 to about 0.25 millimeter between said nozzle and the chill surface.

5. The method of claim 1 wherein the slotted nozzle has a width of from about 0.03 to about 1 millimeter, measured in direction of movement of the chill surface.

6. The method of claim 5 wherein the step of forcing the molten alloy through the slotted nozzle is conducted under vacuum of from about 100 to about 3000 microns.

7. The method of claim 5 wherein the step of forcing the molten alloy through the slotted nozzle is conducted in an inert atmosphere.

8. The method claim 1 wherein the chill surface is provided by a rotating chill roll, and the molten alloy is deposited onto its peripheral surface.

9. The method of claim 8 further comprising the step of directing a stream of inert gas against the surface of the chill roll ahead of the point of contact between the molten alloy and the chill surface.

10. The method of claim 1 wherein the chill surface is provided by moving belt.

11. The method of claim 1 wherein the chill surface is provided by a moving endless belt.

12. The method of forming continuous strip of amorphous metal from a molten alloy capable of forming an amorphous structure, comprising:

(a) forcing the molten metal under pressure through a slotted nozzle onto the peripheral surface of a chill roll, wherein said nozzle is located in close proximity to said peripheral surface such that the gap between the nozzle and said peripheral surface is from about 0.03 to about 1 millimeter, wherein the nozzle has a width of from about 0.3 to about 1 millimeter, measured in the direction of rotation of the chill roll, and wherein the nozzle is positioned generally perpendicular to the direction of rotation of the chill roll;

(b) rotating the chill roll at a predetermined speed to provide a peripheral velocity of from about 200 to about 2000 meters per minute; and (c) quenching the molten metal in contact with the peripheral chill roll surface at a rate of at least about $10^4$° C. per second to effect solidification into a continuous amorphous strip.

13. The method of forming continuous strip of amorphous metal from a molten alloy capable of forming an amorphous structure, comprising:

(a) forcing the molten metal under pressure through a slotted nozzle onto the surface of an endless chill belt, wherein said nozzle is located in close proximity to said surface such that the gap between the nozzle and said surface is from about 0.03 to about 1 millimeter, wherein the nozzle has a width of from about 0.3 to 1 millimeter, measured in longitudinal direction of the belt, and wherein the nozzle is positioned generally perpendicular to the longitudinal direction of the belt;

(b) advancing the belt at a predetermined speed of from about 200 to about 2000 meters per minute; and (c) quenching the molten metal in contact with the surface of the belt at a rate of at least about $10^4$° C. per second to effect solidification into a continuous amorphous strip.

* * * * *